US008844715B2

(12) United States Patent
Lee et al.

(10) Patent No.: US 8,844,715 B2
(45) Date of Patent: Sep. 30, 2014

(54) CAP ASSEMBLY HAVING STORAGE CHAMBER FOR SECONDARY MATERIAL WITH INTEGRAL TYPE WORKING MEMBER

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 697 days.

(21) Appl. No.: 12/311,598

(22) PCT Filed: Dec. 12, 2006

(86) PCT No.: PCT/KR2006/005417
§ 371 (c)(1),
(2), (4) Date: Apr. 2, 2009

(87) PCT Pub. No.: WO2007/069846
PCT Pub. Date: Jun. 21, 2007

(65) Prior Publication Data

US 2010/0025356 A1 Feb. 4, 2010

(30) Foreign Application Priority Data

Dec. 12, 2005 (KR) ..... 10-2005-0122944
May 15, 2006 (KR) ..... 10-2006-0044574
Oct. 18, 2006 (KR) ..... 10-2006-0102720

(51) Int. Cl.
*B65D 25/08* (2006.01)
*B65D 47/24* (2006.01)
*B65D 51/28* (2006.01)

(52) U.S. Cl.
CPC ..... *B65D 47/243* (2013.01); *B65D 51/2864* (2013.01)
USPC ..... 206/219; 206/222; 206/221; 222/129

(58) Field of Classification Search
USPC ..... 222/129, 145.1, 145.3, 145.5, 145.6; 206/219, 222
See application file for complete search history.

(56) References Cited

U.S. PATENT DOCUMENTS

| | | | | |
|---|---|---|---|---|
| 937,049 | A | 10/1909 | Callahan | |
| 3,924,741 | A * | 12/1975 | Kachur et al. | 206/221 |
| 4,195,730 | A * | 4/1980 | Hunt | 206/221 |
| 4,203,517 | A * | 5/1980 | Hildebrandt et al. | 206/221 |

(Continued)

FOREIGN PATENT DOCUMENTS

| | | |
|---|---|---|
| JP | 7223681 A | 8/1995 |
| JP | 2003-002350 | 1/2003 |
| WO | WO 03/059774 A2 | 7/2003 |

OTHER PUBLICATIONS

Search Report from Application No. PCT/KR2006/005417, dated Apr. 13, 2007.

*Primary Examiner* — Tri Mai
(74) *Attorney, Agent, or Firm* — Westman, Champlin & Koehler, P.A.

(57) ABSTRACT

A cap assembly having a storage chamber for a secondary ingredient with an integral type working device, which comprises a cap body and a working device; said cap body including a mouth and a housing sealing part with a droping space which is formed around the mouth; said working device adapted to move vertically, including an inner extended housing which is formed with a storage chamber for containing a secondary ingredient and having at least one outlet above seal portion formed at upper portion of the working device; and when the working device containing a secondary ingredient is assembled to the mouth of the cap body, the chamber is sealed by a housing sealing part.

5 Claims, 8 Drawing Sheets

(56) References Cited

U.S. PATENT DOCUMENTS

| | | | | | |
|---|---|---|---|---|---|
| 4,483,439 | A * | 11/1984 | Steigerwald et al. | 206/219 |
| 5,419,445 | A * | 5/1995 | Kaesemeyer | 215/11.1 |
| 5,433,328 | A * | 7/1995 | Baron et al. | 215/11.4 |
| 6,045,254 | A | 4/2000 | Inbar et al. | 366/130 |
| 6,113,257 | A * | 9/2000 | Sharon et al. | 366/130 |
| 6,148,996 | A | 11/2000 | Morini | 206/222 |
| 6,170,654 | B1 * | 1/2001 | Gartner et al. | 206/219 |
| 7,506,784 | B2 * | 3/2009 | Lee | 222/525 |
| 2005/0115845 | A1 * | 6/2005 | Cho | 206/216 |
| 2005/0211579 | A1 * | 9/2005 | Makita | 206/219 |
| 2007/0074979 | A1 * | 4/2007 | Cho | 206/219 |

* cited by examiner

CAP ASSEMBLY HAVING STORAGE CHAMBER FOR SECONDARY MATERIAL WITH INTEGRAL TYPE WORKING MEMBER

CROSS-REFERENCE TO RELATED APPLICATION

The present application is a Section 371 National Stage Application of International patent application Serial No. PCT/KR2006/005417, filed Dec. 12, 2006, and published as WO 2007/069846 on Jun. 21, 2007, in English the content of which is hereby incorporated by reference in its entirety.

TECHNICAL FIELD

The present invention relates to a cap assembly for closing a container and more particularly to a cap assembly having a storage chamber with an integral type of working device for containing a secondary material for example a concentrated liquid or a granule different from a primary material (ingredient) for example water or a beverage accommodated in a container.

Such a cap assembly is useful in the various industrial fields such as medical, pharmaceutical, cosmetic and etc.

BACKGROUND ART

Generally, when a beverage that requires mixing up a liquid in a container with a granule or a concentrate liquid as additives or secondary ingredients such as carbon dioxide, vitamin powder, etc, it is often necessary that the container has a separate chamber for storage the secondary ingredients.

There are many suggestions more than 5,000 including U.S. Pat. No. 937,049 (filed on Oct. 19, 1909) about the structure for mixing two or more ingredients in a container.

However, the containers disclosed in the above patents have not commercially succeeded because of the problems such as inefficiency in a manufacture process, inconvenience in use, etc.

Particularly, there are further needs for more easily handling of a container and of a working means for mixing two or more ingredients in a container without problems of changing a structure or an injury of an elbow caused by acting an excessive force to open an discharging device.

Recently, PCT/EP2002/004523 filed on Jan. 17, 2002 and Japanese Patent Application No. 2001-00185428 filed on Jun. 19, 2001 suggested other structure, but a commercial success is not obtained.

Particularly, the structure disclosed in Japanese Patent Application mentioned above has a problem that a piece cut out from a discharging port fall into a container and a child may swallow it.

Other structure for separate storage of a secondary ingredient in a container also has a problem that the structure could not be adapted to a neck of a conventional bottle.

DISCLOSURE OF INVENTION

Technical Problem

In view of the above, an object of the present invention is to provide a cap assembly having an improved convenience with a working device.

Another object of the present invention is to provide a cap assembly with a working device which is adapted to open the storage chamber and container at the same time so that a secondary ingredient may be discharged and mixed into a primary ingredient in a container and the mixture may be discharged from the container.

Another object of the present invention is to provide a cap assembly of which a working device having a storage chamber for a secondary ingredient therein thereby simplifying the structure and improving a leakage prevention.

Technical Solution

In order to accomplish the above-mentioned objects, a cap assembly mounted on a neck of a container for containing a ingredient different from that in accommodated in a container according to the present invention, comprising: a cap body having an inner housing formed with a chamber for storage of a secondary ingredient and provided in a direction of discharging a mixture of a primary and secondary ingredients; a working device adapted to open a low end opening of the chamber to allow the secondary ingredient in the chamber of the inner housing to be mixed with a primary ingredient in the container.

The working device may be provided in a direction of a passage of the discharged the mixture of the primary and secondary ingredients.

The low end opening may be sealed by a lower sealing portion of the working device and be opened when the working device is upwardly moved so that the secondary ingredient may be discharged to the primary ingredient in the container.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

Figure 1A:
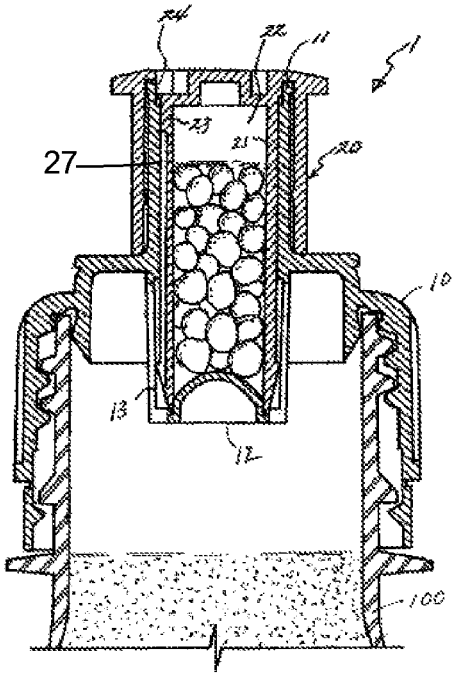
FIG. 1*a* is a cross-sectional view of a cap assembly in accordance with a first embodiment of the present invention in which a working device is in a closed position.

Reference will now be made to the drawings to describe the resent invention in detail. In the following description of the present invention, the same drawing reference numerals are used for the same elements even in different drawings, and the duplicate explanation thereof will be omitted.

Figure 1B:
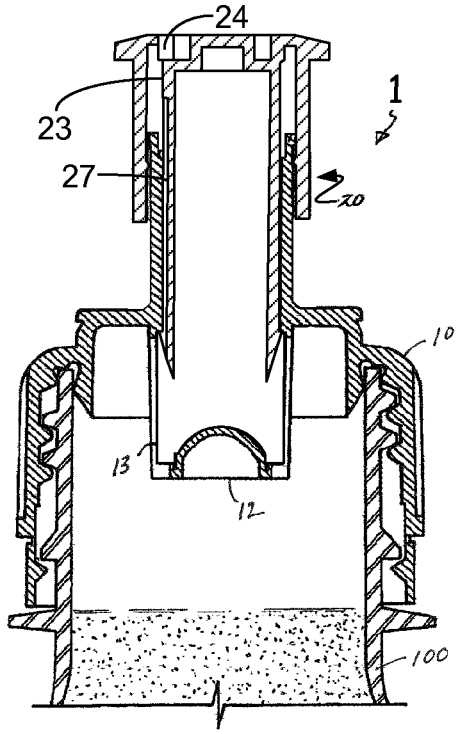
FIG. 1*b* is a cross-sectional view of the cap assembly of FIG. 1*a* with the working device in an opened position.

Referring to FIG. 1, a cap assembly 1 in accordance with the preferred embodiment of the present invention may be removably mounted a neck of a container 100 for example a beverage bottle in such a way of a conventional thread engagement, snap-fit engagement or adhering types.

The cap assembly comprises a cap body 10 and a working device 20.

The cap body 10 includes a mouth 11 and a housing sealing part 12 with a droping space 13.

The working device 20 includes an inner extended housing 21 which is formed with a chamber 22. When the working device 20 is mounted on the mouth 11 of the cap body, a seal portion 23 formed at upper portion of the working device contacts an inner surface of the mouth 11 for sealing.

The working device 20 is formed with at least one outlet 24 above the seal portion 23, which is adapted to be opened when the working device 20 moves upwardly.

When the working device 20 moves upwardly for use, the inner housing 21 is departed from the sealing portion 12, whereby a secondary ingredient is discharged to the container 100 via the dropping space 13 to be mixed with a primary ingredient in the container. At the same time, the seal portion 23 deviates upward above mouth 11 so that outlet 24 is connected to the inside of container 100 through exhaust passage 27 between inner housing 21 and the inner surface of the cap body and a passage 29 defined in part by seal portion 23 such that the mixed content of the inside of container 100 may be ejected through exhaust passage 27, pass over and contact an exterior of seal portion 23, which is outside chamber 22, and then exit at outlet 24.

The moisture of the primary ingredient and secondary ingrdient in the inner housing.

Figure 2:
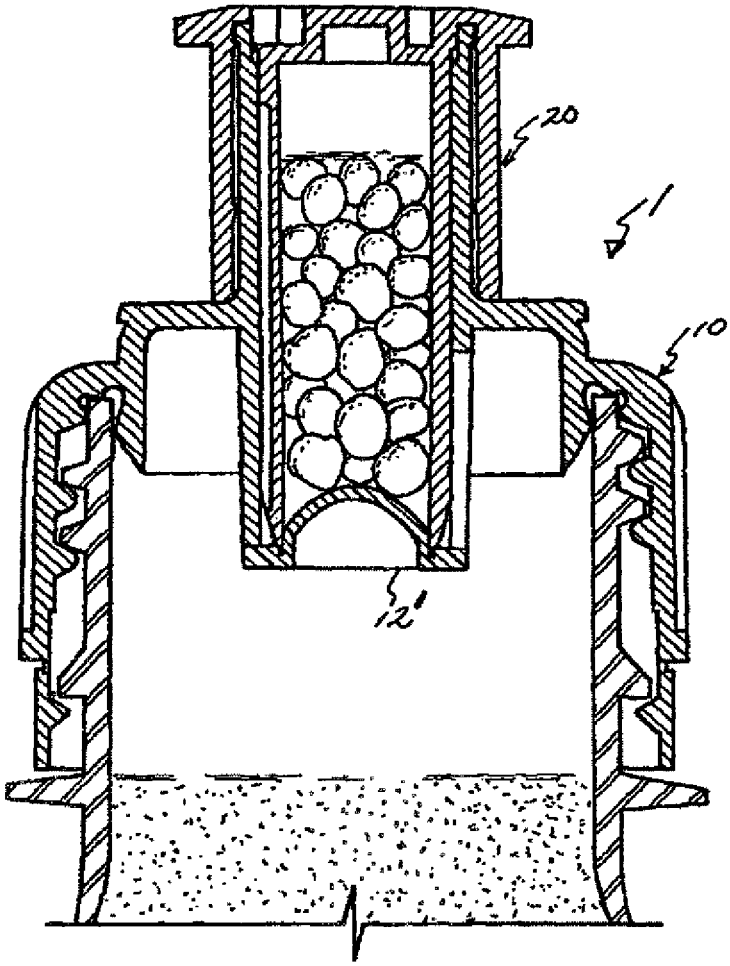
FIG. 2 is a cross-sectional view of cap assembly in accordance with a second embodiment of the present invention.

FIG. 2 shows a second embodiment of the present invention, in which a separate housing sealing part 12 is assembled to the cap body.

Figure 3:
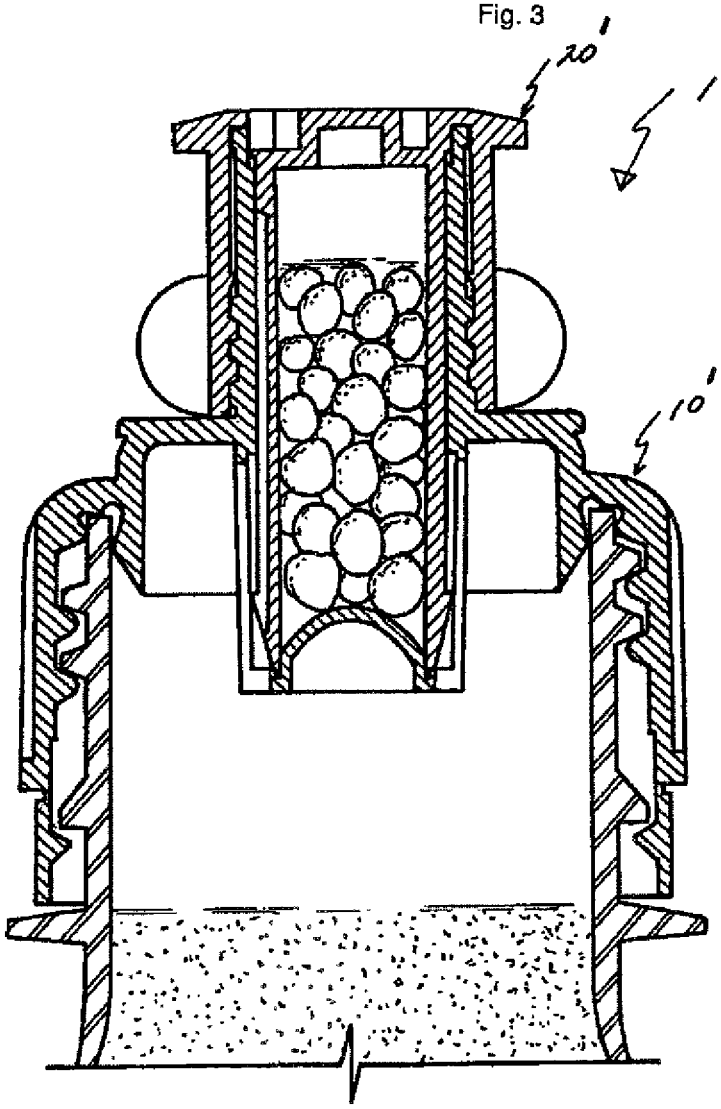
FIG. 3 is a cross-sectional view of cap assembly in accordance with a third embodiment of the present invention.

FIG. 3 shows a third embodiment of the present invention, to open the working device 20', the working device should be vertically moved as in FIG. 1 or the working device may be turned to move vertically as a screw.

Figure 4:
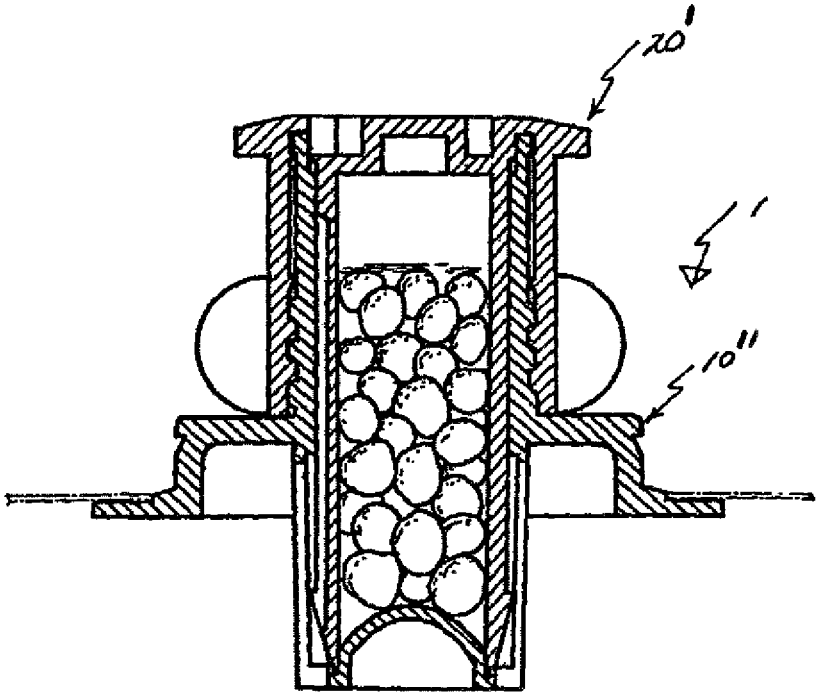
FIGS. 4 to 9 are cross-sectional views of cap assembly in accordance with a various embodiments of the present invention.
Figure 5:
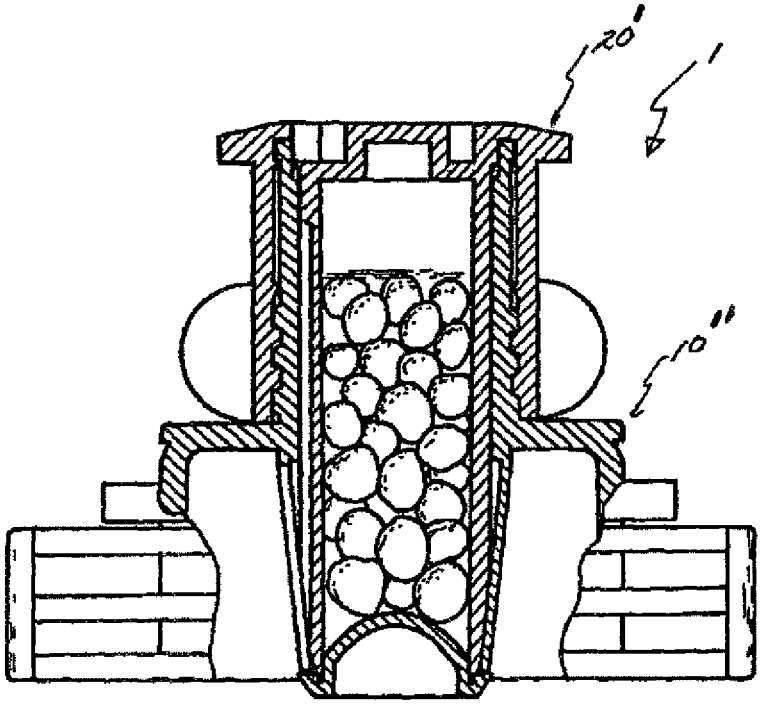

FIG. 4 shows the fourth embodiment of the present invention, in which the cap assembly 1 may be assembled to a paper pack type of container, or may be attached to a pouch type container as shown in FIG. 5.

Figure 6:
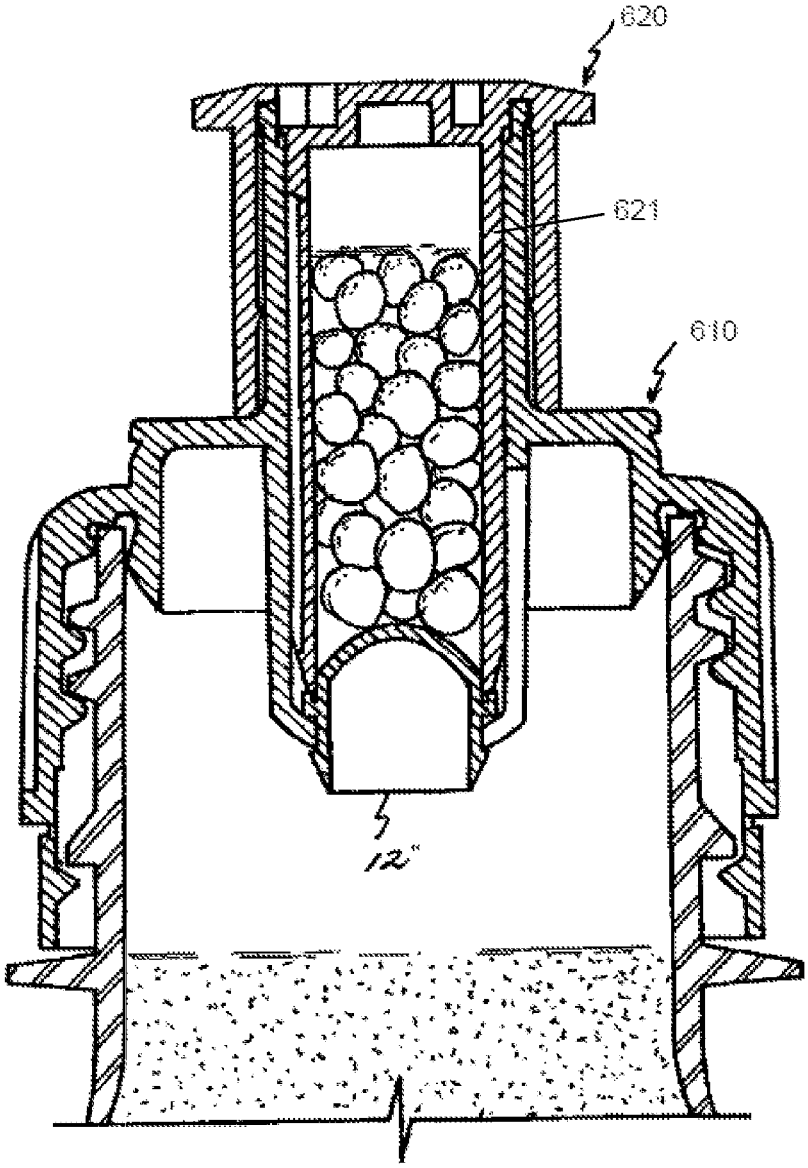

FIG. 6 shows another embodiment of the present invention, in which the housing sealing part 12" is pre-assembled to the inner housing 621 of working device 620 first and then the pre-assembly is assembled to the cap body 610.

Figure 7:
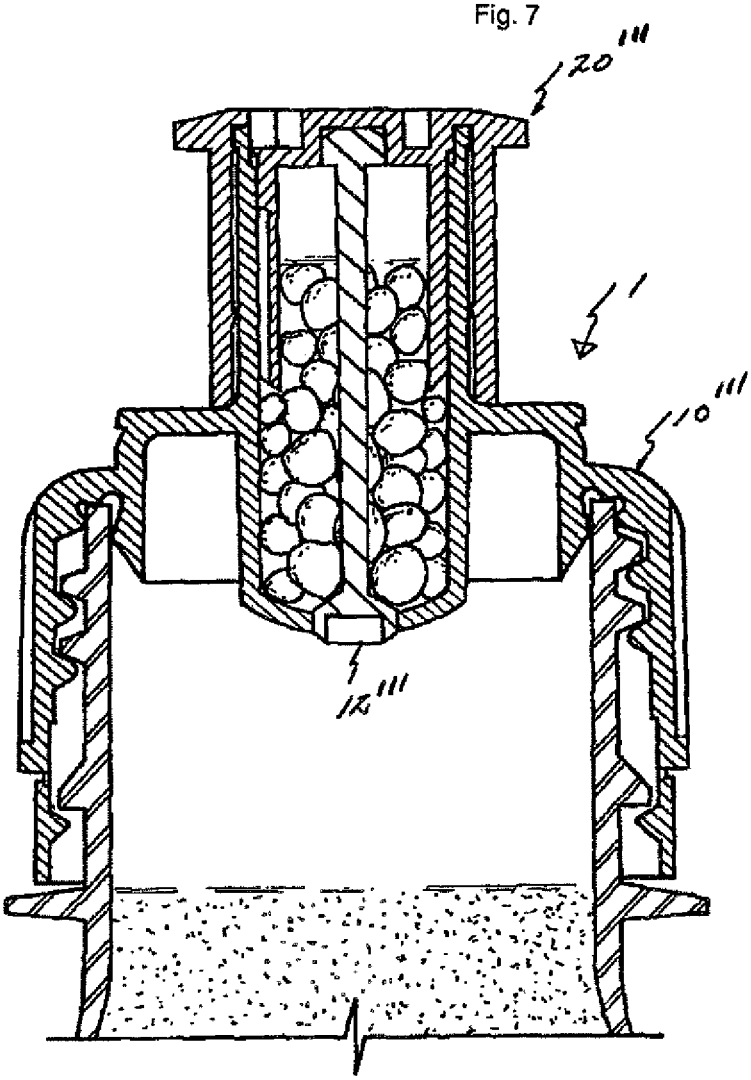

FIG. 7 shows another embodiment of the present invention, in which the housing sealing part 12''' is assembled to the inner housing 21 through the chamber 22.

Figure 8:
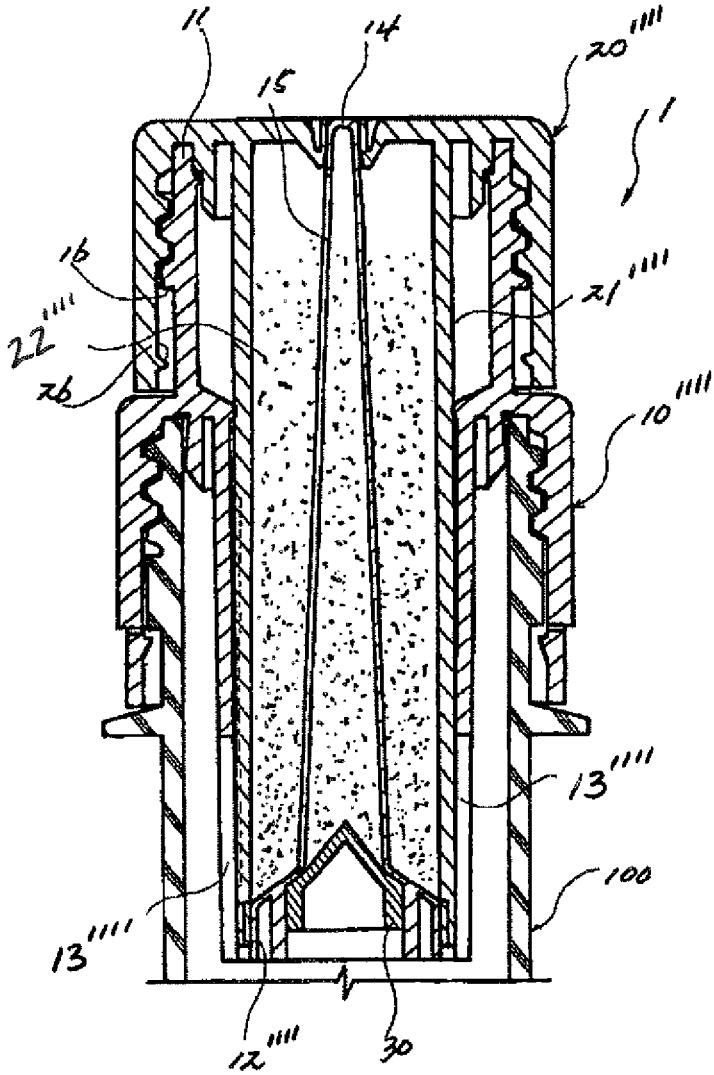

In the embodiment shown in FIG. 8, the outlet for discharging the mixture of the primary ingredient and secondary ingredient is formed at the center of the top portion.

The outlet is sealed by a sealing protrusion 14 which is longitudinally extended and is formed with a vacancy 15 not to reduce a volume of the chamber 22''''.

Furthermore, a port is formed at the bottom of the chamber for easy filing the ingredient and is blocked with a separate plug member 30.

To limit the distance that the working device 20'''' moves vertically, a stopper 26 is formed at the inner surface of the working device 20''' and a stopper 16 is correspondingly formed at the outer surface of the mouth.

Figure 9:
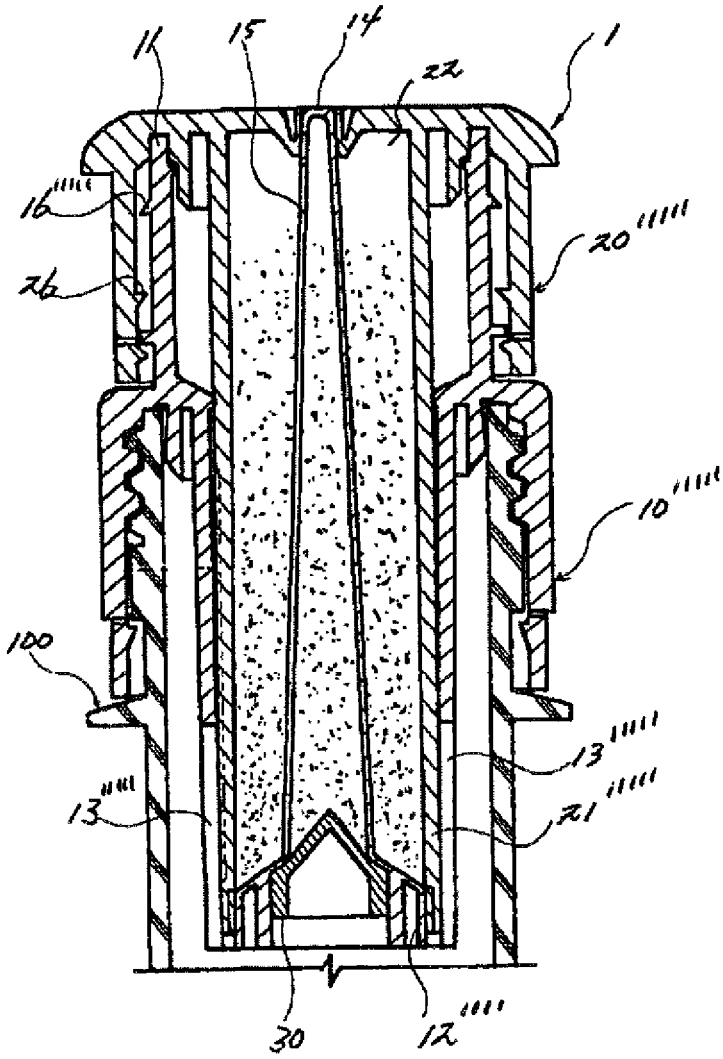

FIG. 9 shows the working device 20''''' may be vertically moved by turning like a screw to be opened.

INDUSTRIAL APPLICABILITY

As apparent from the above description, the cap assembly of the present invention may be adapted to accommodate a concentrated liquid or a granule to be mixed which a water, a beverage or other liquid in the container with an easy and improved mixing two different ingredients, which may be advantageous in the various industrial fields such as medical, pharmaceutical, cosmetic and etc.

While the preferred embodiment in accordance with the present invention has been shown and described, equivalent modifications and changes known to persons skilled in the art according to the present invention are considered to be within the scope of the present invention as defined in the appended claims.

The invention claimed is:

1. A cap assembly comprising:

a cap body mounted to a container and having a housing sealing part, a mouth and an inner surface extending vertically down from the mouth;

a working device having an inner housing, a seal portion, and an outlet located above the seal portion, wherein:

when the working device is mounted on the mouth of the cap body, an exterior of the seal portion contacts the inner surface extending down from the mouth of the cap body and seals an interior of the container from an exterior of the container and the inner housing contacts the housing sealing part such that a chamber defined within the inner housing is sealed by the inner housing and the housing sealing part; and when the working device is moved vertically relative to the cap body, the seal portion moves vertically above the inner surface of the cap body such that an exhaust passage is positioned between the inner housing and the inner surface of the cap body to allow contents of the container to move through the exhaust passage between the inner housing and the inner surface, across and in contact with the exterior of the seal portion and then out the outlet of the working device and the inner housing separates from the housing sealing part to open the chamber to the container.

2. The cap assembly in accordance with claim 1, wherein said housing sealing part is separately assembled to the inner housing.

3. A cap assembly for a container holding a liquid, the cap assembly having a storage chamber for a secondary ingredient with an integral type working device, comprising:

a cap body and a working device;

said cap body including a mouth and a housing sealing part with a dropping space;

said working device adapted to move vertically and including an inner housing which is formed with a storage chamber for containing a secondary ingredient and having an outlet above a seal portion formed at an upper portion of the working device; and when the working device containing a secondary ingredient is assembled to the mouth of the cap body, the chamber is sealed by the housing sealing part and when the working device is moved vertically, the working device separates from the housing sealing part thereby allowing the secondary ingredient to pass through the dropping space while the seal portion moves above the cap body thereby allowing contents from the container to pass through an exhaust passage between the working device and the cap body, then, while remaining outside of the storage chamber, across the seal portion to reach the outlet.

4. The cap assembly in accordance with claim 3, wherein said housing sealing part is separately assembled to the housing.

5. A cap assembly having a storage chamber for a secondary ingredient with an integral type working device, comprising:

a cap body and a working device;

said cap body including a mouth with an inner surface and a housing sealing part with a dropping space;

said working device having an outlet above the cap body, an inner housing formed with a storage chamber, and a seal portion;

wherein in a first position, the seal portion of the working device seals the outlet from the inner surface of the cap body, and the housing sealing part and the inner housing seal the storage chamber from the dropping space; and in a second position, the seal portion is above the mouth to provide a passage between the inner surface of the mouth and the working device and a passage outside the storage chamber defined in part by the seal portion wherein in the second position, the inner housing is separated from the housing sealing part.

* * * * *